US008130168B1

(12) United States Patent
Sergi et al.

(10) Patent No.: US 8,130,168 B1
(45) Date of Patent: Mar. 6, 2012

(54) APPARATUS FOR RAISING AND LOWERING AN ANTENA

(75) Inventors: Paul D. Sergi, Peninsula, OH (US); Edward L. Merical, Canal Fulton, OH (US); Christopher R. Cummings, Newton Falls, OH (US)

(73) Assignee: PDS Electronics, Inc., Tallmadge, OH (US)

( * ) Notice: Subject to any disclaimer, the term of this patent is extended or adjusted under 35 U.S.C. 154(b) by 393 days.

(21) Appl. No.: 12/587,573

(22) Filed: Oct. 13, 2009

(51) Int. Cl.
*H01Q 3/02* (2006.01)
*H01Q 1/12* (2006.01)

(52) U.S. Cl. ..... 343/882; 343/890; 343/878; 343/891; 343/892

(58) Field of Classification Search ..... None
See application file for complete search history.

(56) References Cited

U.S. PATENT DOCUMENTS

| | | | | |
|---|---|---|---|---|
| 3,952,984 | A * | 4/1976 | Dimitry | 248/282.1 |
| 4,677,444 | A * | 6/1987 | Perek | 343/882 |
| 5,673,459 | A * | 10/1997 | Baghdasarian | 16/308 |
| 5,721,558 | A | 2/1998 | Holemans | 343/895 |
| 6,361,007 | B1 | 3/2002 | Oby et al. | 248/285.1 |
| 6,456,258 | B1 * | 9/2002 | Bragg et al. | 343/892 |
| 6,982,680 | B2 | 1/2006 | Janoschka et al. | 343/878 |
| 7,004,043 | B2 | 2/2006 | Erel et al. | 74/89.23 |
| 7,015,872 | B1 * | 3/2006 | Little | 343/890 |
| 7,027,007 | B2 * | 4/2006 | Hossein | 343/890 |
| 7,432,875 | B1 | 10/2008 | Sergi | 343/890 |
| 2006/0026797 | A1 | 2/2006 | Coyle | 16/280 |

* cited by examiner

*Primary Examiner* — Trinh Dinh
(74) *Attorney, Agent, or Firm* — Renner, Kenner, Greive, Bobak, Taylor & Weber

(57) ABSTRACT

The mast (11) of an antenna is pivotally carried by a post (12) by a hinge assembly (13). A pedestal (33) is carried by the post (12) and is adapted to carry a winch (40) having a line (46) with a hook (47) at the end thereof. A hook mount (50) is carried by the mast (11) and is adapted to receive the hook (47) of the winch (40). A locking bracket (56) is carried by the mast (11) and is connected to the pedestal (33) when the mast (11) is positioned adjacent to the post (12). An insulator bar (29) is positioned between the mast (11) and the hinge assembly (13) and the locking bracket (56).

24 Claims, 3 Drawing Sheets

APPARATUS FOR RAISING AND LOWERING AN ANTENA

TECHNICAL FIELD

This invention relates to a system of raising an antenna from a horizontal position or lowering the antenna from the vertical position to the horizontal position.

BACKGROUND ART

The mast of a vertical antenna is usually mounted to a support post which is positioned in the ground. Not only is the raising of the antenna and its attachment to the post at times difficult, but also when it becomes necessary to repair or re-tune an existing antenna, the user must climb a ladder or utilize some other type of elevating device to obtain access to the antenna. Such is a tedious and potentially dangerous operation. Alternatively, the user could disassembly the antenna mast from the post, carefully lower the antenna to the ground, and thereafter perform the desired tasks on the antenna. After those tasks are performed, the user would then have to raise the antenna and hold it in position which reattaching it to the post.

As a result of these problems, the device of U.S. Pat. No. 7,432,875 was designed to be used to tilt antennas from a prone to a vertical position. While this device is very effective for its intended purpose to work in conjunction with small antennas, it is not suited for use with large antennas. Thus, the need exists for such a device which is useable with antennas of all sizes.

DISCLOSURE OF THE INVENTION

It is thus an object of one aspect of the present invention to provide an antenna having an apparatus for raising and lowering its mast between horizontal and vertical positions.

It is an object of another aspect of the present invention to provide an apparatus, as above, which is useable with large vertical antennas.

It is an object of an additional aspect of the present invention to provide an apparatus, as above, which enables one person to raise or lower the mast.

It is an object of a further aspect of the present invention to provide an apparatus, as above, which is inexpensive to manufacture and easy to use.

These and other objects of the present invention, as well as the advantages thereof over existing prior art forms, which will become apparent from the description to follow, are accomplished by the improvements hereinafter described and claimed.

In general, an apparatus for raising or lowering an antenna mast carried by a post includes a hinge assembly adapted to be connected to the mast and the post and permitting pivoting of the mast relative to the post. A pedestal is adapted to be carried by the post and is adapted to carry a winch having a line with a hook at the end thereof. A hook mount is adapted to be carried by the mast and is adapted to receive the hook of the winch. A locking bracket is adapted to be carried by the mast and is connected to the pedestal when the mast is in the raised position.

An antenna adapted to be attached to a post includes a mast and a hinge assembly adapted to connect the mast to the post so that the mast may be pivoted with respect to the post. A pedestal is adapted to be carried by the post and adapted to carry a winch having a line with a hook at the end thereof. A hook mount is carried by the mast and is adapted to receive the hook of the winch. A locking bracket is carried by the mast and is connected to the pedestal when the mast is positioned adjacent to the post.

A preferred antenna having an apparatus for raising and lowering its mast according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
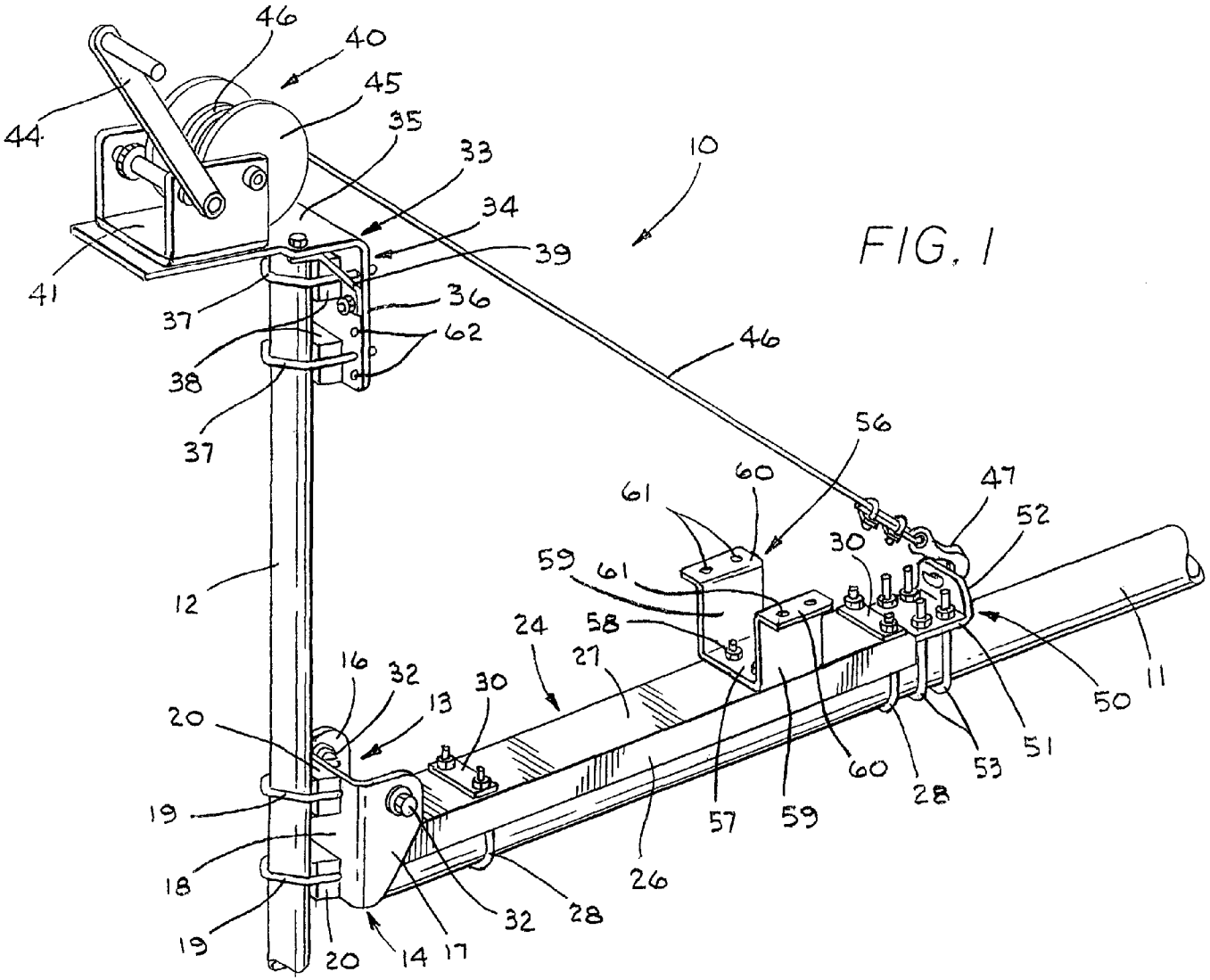
FIG. 1 is a fragmented perspective view of an apparatus of the present invention showing the antenna mast lowered.

An apparatus for raising and lowering an antenna between a horizontal and vertical position is generally indicated by the numeral 10 and is shown as being operable with the mast 11 of an antenna which is carried by a post 12 that is positioned in the ground. Mast 11 is shown in the generally horizontal position, in which it could be laying on the ground, in FIG. 1, and in FIG. 2 mast 11 is shown being supported in the generally vertical position by post 12.

Mast 11 is pivotally attached to post 12 by a preferably metallic hinge assembly generally indicated by the numeral 13. Hinge assembly 13 includes a generally U-shaped first hinge bracket 14 which is adapted to be attached to post 12, and a generally U-shaped second hinge bracket 15, best seen in FIG. 4, which is adapted to be attached to mast 11. Bracket 14 thus includes spaced branches 16, 17 carried by a base member 18. Base member 18 is attached to post 12 by means of conventional U-bolts 19 extending around post 12 and through base member 18. A saddle clamp 20 is positioned between post 12 and each base member 18 so that post 12 is sandwiched between U-bolts 19 and saddle clamps 20.

Figure 4:
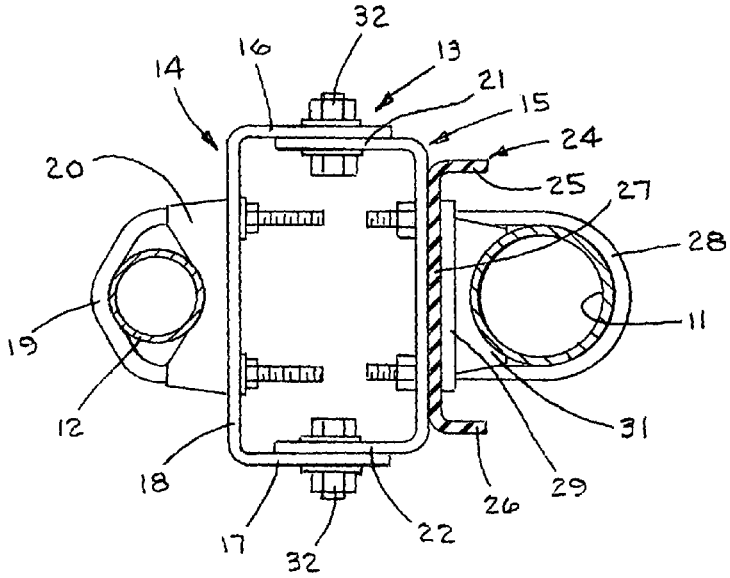
FIG. 4 is a sectional view taken substantially along line 4-4 of FIG. 2.

As best shown in FIG. 4, bracket 15 includes spaced ears 21, 22 carried by a base plate 23. Because bracket 15 is preferably made of a metallic material, as previously described, and because antenna mast 11 must be isolated from all metallic items such as bracket base plate 23, in order to function properly as an antenna, an insulator bar, generally indicated by the numeral 24, is positioned between mast 11 and bracket 15. Bar 24 is in the form of a channel having sides 25, 26 spaced by a base 27. Bar 24 extends along the length of mast 11 and is attached to mast 11 by U-bolts 28. These U-bolts are positioned near the top and bottom of bar 24 and each extend through a spacer plate 29 positioned within the channel of bar 24 and a backing plate 30 (best seen in FIG. 1) positioned on the side of bar 24 opposite to the channel. A saddle clamp 31 is positioned between each spacer plate 29 and mast 11 so that mast 11 is sandwiched between U-bolts 28 and saddle clamps 31.

Bracket 15 is attached to bar 24 by fasteners (one shown) which extend through the base 27 of bar 24 and through the base plate 23 of bracket 15, as shown in FIG. 4. Ears 21, 22 of bracket 15 are received within branches 16, 17 of bracket 14, and a pivot pin assembly 32 is provided through aligned openings in ears 21, 22 and branches 16, 17 respectively. As a result, mast 11 may be pivoted with respect to post 12 on pin assemblies 32 between the FIG. 1 and FIG. 2 positions.

A winch pedestal, generally indicated by the numeral 33, is carried at the top of post 12. Pedestal 33 includes an L-shaped plate 34 having a platform branch 35 and a mounting branch 36. U-bolts 37 attach branch 36 to post 12 with saddle clamps 38 therebetween. Support struts 39 extend angularly between mounting branch 36 and platform branch 35 to provide additional support which may be needed because platform portion 35 is adapted to carry a winch generally indicated by the numeral 40.

Winch 40 is a conventional item which can be removeably mounted to winch pedestal 33. Winch 40 thus includes a clevis-like base 41 attachable to platform 35 as by bolts 42 recessed through slot openings 43 (FIG. 3) in platform 35. As is known to one skilled in the art, openings 43 readily permit to easy attachment of winch 40 to platform 35 or the facile removal of winch 40 from platform 35. Base 41 rotatably carries a handle 44 which is operatively connected, as by gears, to a spool 45 which carries a supply of line 46 such as a strap, rope or the like. A hook 47 is carried by the end of line 46 which can be attached to a hook mount, generally indicated by the numeral 50, which is carried by mast 11 as now will be described.

Figure 2:
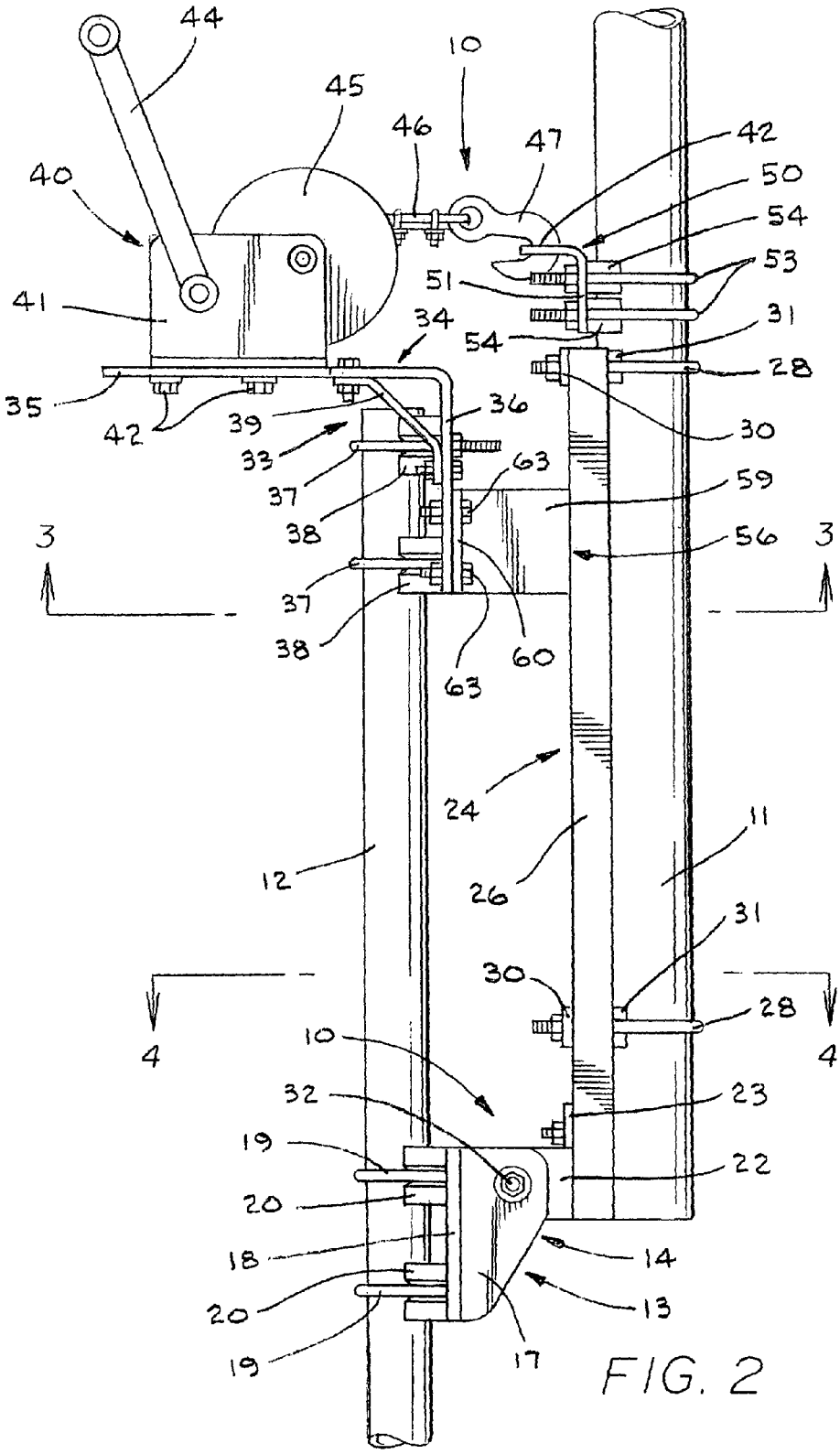
FIG. 2 is a fragmented perspective view of the apparatus of FIG. 1 showing the antenna mast raised in its operative position.
Figure 3:
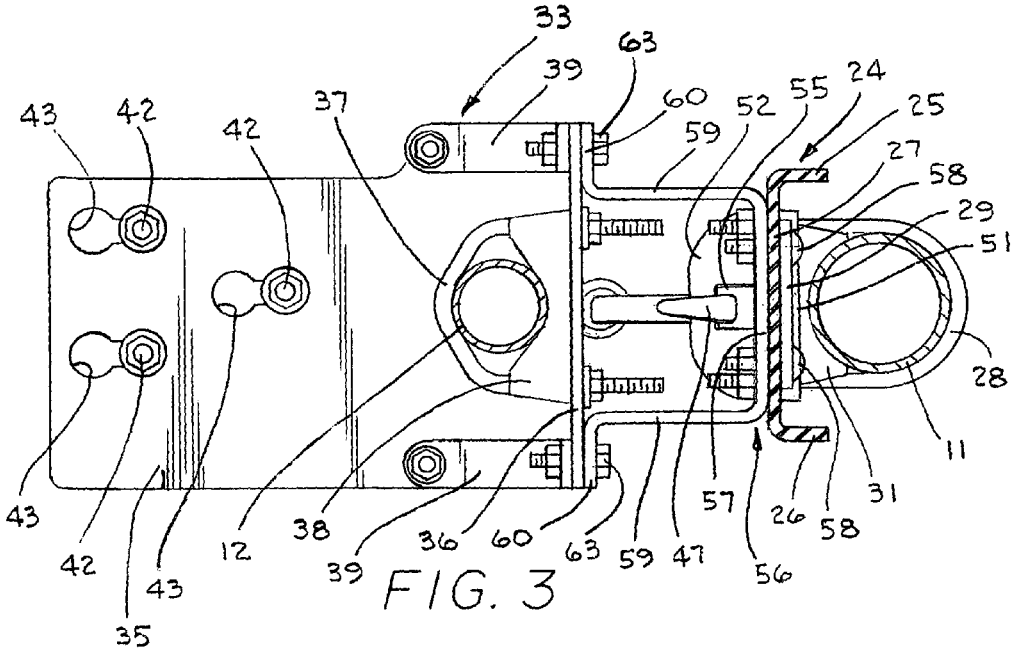
FIG. 3 is a sectional view taken substantially along line 3-3 of FIG. 2.

Hook mount 50 is generally L-shaped having legs 51 and 52 disposed at generally a right angle to each other. Leg 51 is attached to mast 11 by U-bolts 53, with saddle clamps 54 therebetween. Because a metallic line 46 is preferably not utilized, insulator bar 24 need not extend between hook mount 50 and mast 11. Leg 52 of hook mount 50 extends outwardly away from mast 11 and has an aperture 55 therein which is adapted to receive winch hook 47 as best shown in FIG. 3. Thus, when a winch 40 is mounted on pedestal 33 and hook 47 connected to hook mount 50, mast 11 can be lowered from the upright FIG. 2 position to the lowered position shown in FIG. 1, or can be pulled from the lowered position of FIG. 1 to the upright position of FIG. 2 and locked in place in a manner now to be described.

Mast 11 carries a metallic U-shaped locking bracket generally indicated by the numeral 56. Specifically, the base 57 of bracket 56 is attached to the base 27 of insulator bar 24, as by fasteners 58. Opposed branches 59 extend outwardly from the ends of base 57 and carry mounting flanges 60 at the ends thereof. Flanges 60 have apertures 61 therethrough which can be aligned with apertures 62 in mounting branch 36 of winch pedestal 33 when winch 40 has lifted mast 11 to the upright position of FIG. 2. At that time, bolts 63 can be extended through apertures 61 and 62 to lock mast 11 in the upright position to post 12. If desired, one of the bolts 63 could be replaced with a padlock so as to prevent unauthorized lowering of the antenna mast 11.

Thus, once all of the components of apparatus 10 are attached to mast 11 and post 12, as described herein, a winch 40 may be mounted on pedestal 33 and its hook 47 received through aperture 55 of hook mount 50. With mast 11 laying on the ground, as generally shown in FIG. 1, rotation of winch handle 44 will easily raise mast 11 until flanges 60 of bracket 56 engage branch 36 of winch pedestal 33. At that time, bolts 63 can be utilized to lock mast 11 in the upright position, as just described, at which time winch 40 can be removed from pedestal 30, if desired. Of course, to lower mast 11, all that need be done is to put a winch 40 back on pedestal 30 and with hook 47 engaging hook mount 50, bolts 63 can be removed so that mast 11 can be lowered.

In view of the foregoing, it should be evident that an apparatus constructed as described herein accomplishes the objects of the present invention and otherwise substantially improves the art.

What is claimed is:

1. Apparatus for raising or lowering an antenna mast carried by a post comprising a hinge assembly adapted to be connected to the mast and the post permitting pivoting of the mast relative to the post, a pedestal adapted to be carried by the post and adapted to carry a winch having a line with a hook on the end thereof, a hook mount adapted to be carried by the mast and adapted to receive the hook of the winch, and a locking bracket adapted to be carried by the mast and being connected to said pedestal when the mast is in the raised position.

2. The apparatus of claim 1 further comprising an insulator bar adapted to be positioned between the mast and said hinge assembly and between the mast and said locking bracket.

3. The apparatus of claim 1 wherein said hinge assembly includes a first bracket adapted to be attached to the post and a second bracket adapted to be attached to the mast.

4. The apparatus of claim 3 further comprising an insulator bar adapted to be positioned between said second bracket and the mast.

5. The apparatus of claim 3 wherein said first bracket is generally U-shaped having a base adapted to be attached to the post and opposed branches, and said second bracket includes a base plate adapted to be attached to the mast and opposed ears extending from said base plate.

6. The apparatus of claim 5 wherein said ears are adapted to be positioned between said branches, and said hinge assembly further includes a pin assembly adapted to pivotally attach each said ear to each said branch.

7. The apparatus of claim 1 wherein said pedestal including a platform adapted to carry the winch and a branch extending from said platform and adapted to be attached to the post.

8. The apparatus of claim 7 wherein said pedestal further includes at least one strut extending between said platform and said branch.

9. The apparatus of claim 7 wherein said locking bracket is connected to said branch when the mast is in the raised position.

10. The apparatus of claim 1 wherein said locking bracket include a base adapted to be attached to the mast, branches extending outwardly from said base, and flanges on said branches, said flanges being connected to said pedestal when the mast is in the raised position.

11. The apparatus of claim 10 further comprising an insulator bar adapted to be positioned between said base and the mast.

12. The apparatus of claim 1 wherein said hook mount includes a first leg adapted to be attached to the mast and a second leg having an opening therein adapted to receive the hook of the winch.

13. An antenna adapted to be attached to a post comprising a mast, a hinge assembly adapted to connect said mast to the post so that said mast may be pivoted with respect to the post, a pedestal adapted to be carried by the post and adapted to carry a winch having a line with a hook at the end thereof, a hook mount carried by said mast and adapted to receive the hook of the winch, and a locking bracket carried by said mast and being connected to said pedestal when said mast is positioned adjacent to the post.

14. The antenna of claim 13 further comprising an insulator bar positioned between said mast and said hinge assembly and between said mast and said locking bracket.

15. The antenna of claim 13 wherein said hinge assembly includes a first bracket adapted to be attached to the post and a second bracket attached to said mast.

16. The antenna of claim 15 further comprising an insulator bar positioned between said second bracket and said mast.

17. The antenna of claim 15 wherein said first bracket is generally U-shaped having a base adapted to be attached to the post and opposed branches, and said second bracket includes a base plate attached to said mast and opposed ears extending from said base plate.

18. The antenna of claim 17 wherein said ears are adapted to be positioned between said branches, and said hinge assembly further includes a pin assembly adapted to pivotally attach each said ear to each said branch.

19. The antenna of claim 13 wherein said pedestal including a platform adapted to carry the winch and a branch extending from said platform and adapted to be attached to the post.

20. The antenna of claim 19 wherein said pedestal further includes at least one strut extending between said platform and said branch.

21. The antenna of claim 19 wherein said locking bracket is connected to said branch when said mast is in the raised position.

22. The antenna of claim 13 wherein said locking bracket include a base attached to said mast, branches extending outwardly from said base, and flanges on said branches, said flanges being connected to said pedestal when said mast is in the raised position.

23. The antenna of claim 22 further comprising an insulator bar positioned between said base and said mast.

24. The antenna of claim 13 wherein said hook mount includes a first leg attached to the mast and a second leg having an opening therein adapted to receive the hook of the winch.

* * * * *